United States Patent [19]

Svyatsky et al.

[11] Patent Number: 4,928,946

[45] Date of Patent: May 29, 1990

[54] VERTICAL FEED MECHANISM FOR DOCUMENTS

[75] Inventors: Eduard Svyatsky, Chicago; Jerry W. Loftis, Libertyville; Thomas Faber, Skokie, all of Ill.

[73] Assignee: Bell & Howell Company, Chicago, Ill.

[21] Appl. No.: 198,474

[22] Filed: May 25, 1988

[51] Int. Cl.[5] ..... B65H 5/06

[52] U.S. Cl. ..... 271/10; 271/111; 271/122; 271/126; 271/151; 271/227; 271/237

[58] Field of Search ..... 271/31.1, 126, 122, 271/148, 150, 151, 237, 277, 10, 110, 111

[56] References Cited

U.S. PATENT DOCUMENTS

| | | | |
|---|---|---|---|
| 3,894,732 | 7/1975 | Müller | 271/150 X |
| 3,982,749 | 9/1976 | Stobb | 271/149 X |
| 4,177,982 | 12/1979 | Bewersdorf | 271/150 X |
| 4,483,530 | 11/1984 | Spencer | 271/236 |
| 4,635,922 | 1/1987 | Roetter | 271/149 X |
| 4,674,735 | 6/1987 | DuBois | 271/122 X |
| 4,757,985 | 7/1988 | Hamant | 271/149 X |
| 4,801,134 | 1/1989 | Yokoyama | 271/122 |

FOREIGN PATENT DOCUMENTS

| | | | |
|---|---|---|---|
| 62943 | 7/1968 | German Democratic Rep. | 271/150 |

*Primary Examiner*—Richard A. Schacher

*Attorney, Agent, or Firm*—Laff, Whitesel, Conte & Saret

[57] ABSTRACT

An improved document feed mechanism for feeding documents in a vertical direction through at least two stations including a device for shingling the documents in at least one station by having successive ones of the documents overlap one another to thereby compress the amount of vertical space required for the feeding operation as opposed to the space that would be required if the documents were fed top edge to bottom edge, respectively.

18 Claims, 12 Drawing Sheets

VERTICAL FEED MECHANISM FOR DOCUMENTS

BACKGROUND OF THE INVENTION

In the field of automatic sorting of documents such as mail, or advertising materials, there have been several approaches to the presentation of data on said documents for use by an operator to be introduced into a data bank for later use.

Many such devices feed the documents in a horizontal fashion in an end-to-end relationship, but this type of feed mechanism requires outsized elongated work stations in order to provide adequate space for accommodation of the end-to-end sequential disposition of the documents as they parade before the operator. Attempts have been made to feed documents in a vertical sequence, but such efforts have resulted in work stations that generally became exceedingly tall. Additionally, both of these formats experienced difficulties in that a plurality of documents were often moved into the mechanism simultaneously resulting in jams. Another feature of such devices was the disposition of the document delivery trays which normally had a positive angular disposition, namely, the stack of documents were moved downwardly toward the feedrollers of the vertical feed mechanism. The positive angular disposition of the document delivery trays seriously contributed to jams at the entrance to the mechanism when the effect of gravity forced the stack of documents against the feed means at the entrance to the mechanism causing it to become inoperative when the stack became overcompressed and preventing a single document from being moved from the end of the stack into the mechanism.

BRIEF SUMMARY OF PRESENT INVENTION

The present invention relates to an improved feeder, preferably vertical, wherein the documents are shingled to economize on the vertical height of the machine which is provided with a plurality of stations. At each of the stations a particular function is accomplished, including a reading station where the documents are restrained in a predetermined orientation for observance by the operator. It also includes a device for elimination of doubling up at the in-feed station and whereby the second document is returned to the stack to await its sequential introduction to the feeding mechanism.

A further object of the present invention is to provide a negative angled feed tray wherein the anterior end of the feed tray is at the upper level of the in-feed mechanism and the distal or rearward end of the negative feed tray is disposed below the horizontal line passing through the juncture of the anterior end and the in-feed to the mechanism. This provides an up-hill path for a stack of documents which are disposed on edge and moved by transporter means up the hill to engage the in-feed rollers into the feed mechanism. By providing the negative angular relationship of the feed tray, the stack will be compressed by gravity in the direction of the distal end and thereby present a lead document which is free of any compressive forces from the stack when it is engaged by in-feed rollers at the top of a vertical feeding mechanism.

Another object of the present invention is to provide sequential shingling of successive documents at one or more stations in the feed mechanism.

Still another object of the present invention is to provide a means for orienting each sequential document to a predetermined position and holding the document in the predetermined position for reading by an operator so that the operator can observe data on the face of the document and introduce that data into a data bank for later use.

A further object is to provide means in a vertical document feeder whereby skewed documents will be straightened into an appropriate horizontal relationship for easy reading by the operator.

Still another object of the present invention is to provide a device which has a plurality of sensor mechanisms for insuring proper operation of the mechanism and for correction of skewed documents, as well as having a transporting means for lateral movement of individual documents from the feed mechanism to means for producing indicia means on the face of the document, i.e., a bar code printer or similar device, whereby the indicia means can be later utilized for automatic sorting of the documents.

Other objects of the present invention will become apparent to those skilled in the art when the attached specification is read in conjunction with the drawing wherein:

DETAILED DESCRIPTION

Figure 1:
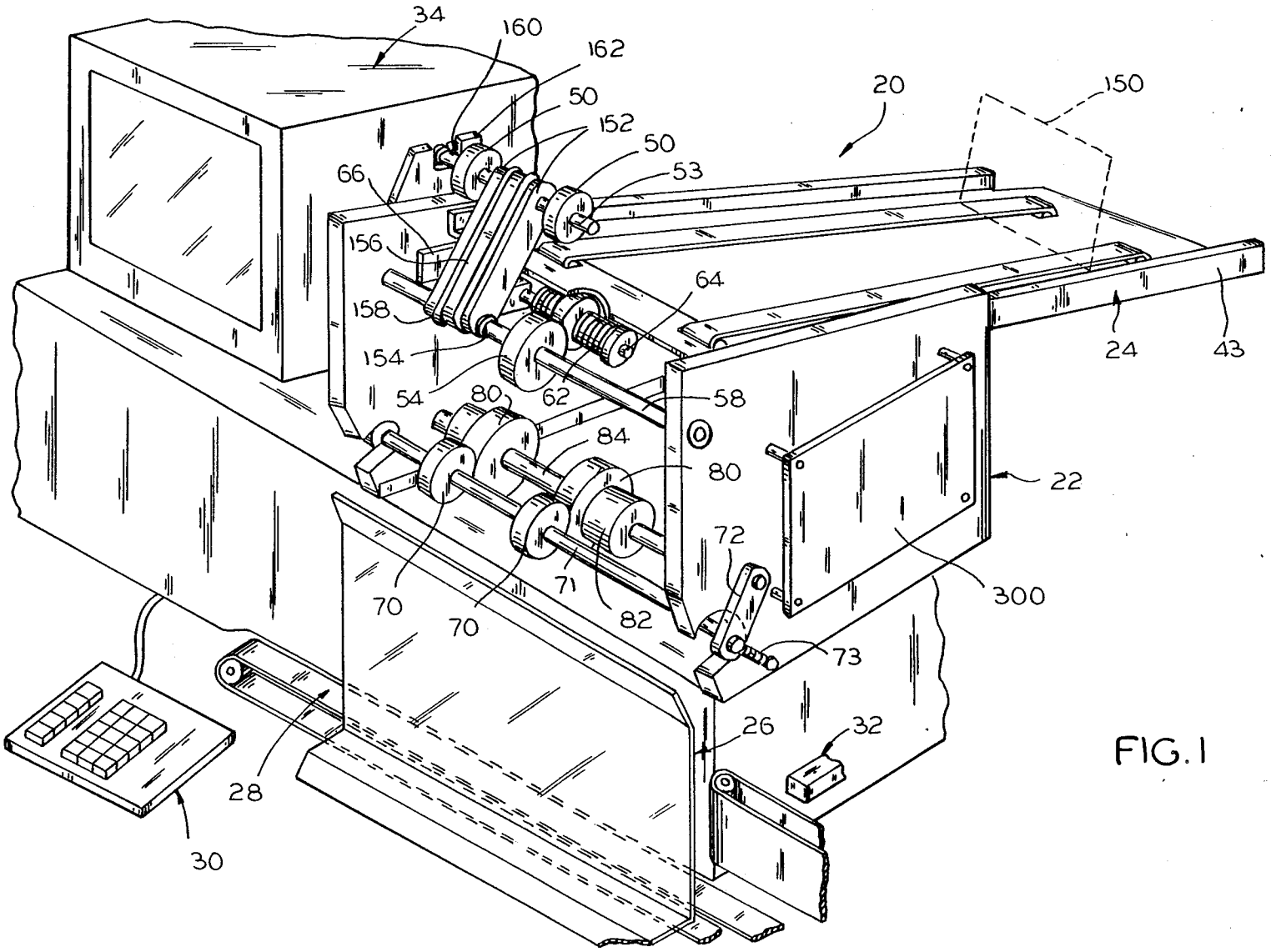
FIG. 1 is an enlarged perspective view of a preferred embodiment of the present invention, said embodiment being shown with a portion of its housing and its guide plate removed for a clearer showing of the internal mechanism of the device contemplated by the present invention.

Referring now to the drawing wherein similar parts are designated by similar numerals, and particularly referring to FIG. 1, a system 20 of the type contemplated by the present invention generally includes a vertical feed mechanism 22; a negative angle powered feed tray 24 (the moveable backsupport 150 being shown in phantom); a guide means 26 for receiving and guiding the documents fed from mechanism 22; a horizontal transporter 28 for receiving and laterally moving the documents from behind the guide 26; a keyboard 30 for introducing the data received from the documents for input into a data base (for later use); an indicia means applier, generally in the form of a bar code printer 32; and a CRT (screen) 34 for management of the entire system.

Because of large volumes of mail and other forms of documents such as credit card information, it has become necessary to provide means for automatic sorting of the envelopes or documents for bulk mail distribution to particular distribution points within the system of the Post Office. In order to accomplish this, it is necessary to provide indicia means on the face of the envelope which can be readily observed and read by automatic electronic means such as a bar code reader.

The present invention is related to a feeder mechanism which, however, can be employed in many diverse types of equipment where it is desired to single out individual envelopes or documents for various purposes. The present disclosure relates to the use of a vertical feeder in a bar code printer system where a large stack of envelopes is placed on the feeder tray 24 and the individual envelopes are sequentially fed down the vertical feeder mechanism 22 to a position where the operator can visually observe the address or other data on the face of the document, introduce the zip code or other necessary information into a data bank by operation of the keyboard 30, and then when the document is released to the lateral transporter 28 it will pass through the bar code printer 32 for application of the information directly to the face of the envelope or document.

Figure 3A:
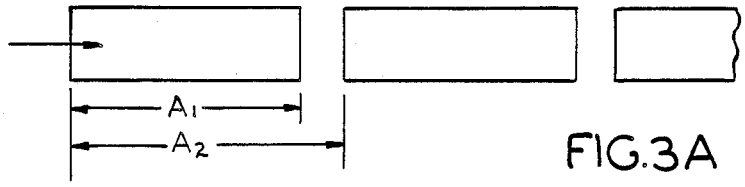
FIGS. 3A and 3B show schematically the horizontal and vertical disposition of document feeding which was found in the prior art.
Figure 3B:
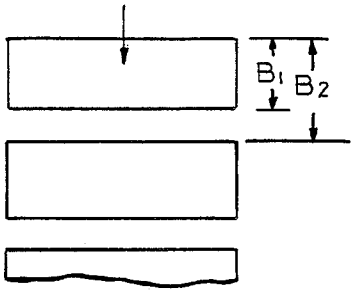

In prior art handling devices, whether they were horizontally or vertically disposed, it was necessary to provide adequate space to accept the documents in an end-to-end relationship as seen in FIG. 3A, or in a vertical edge-to-edge relationship, as seen in FIG. 3B. It will be observed, in FIG. 3A, that for each envelope, it is necessary to not only have adequate space for the length of the envelope, designated by the measurement A1, but also to provide a spacing between the envelopes designated by the overall dimension A1. This required an elongated table or rack means whereby the envelopes were fed sequentially along a transporting mechanism to a station where the operator could view and control the input of information to a data bank. In those instances where a vertical document disposition was used, there similarly were requirements for the top to bottom measurement of the envelope designated B1 and the overall spacing from top to top of adjacent sequential envelopes designated B2, as shown schematically in FIG. 3B.

Figure 3C:
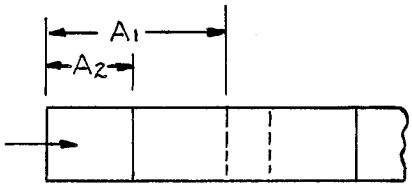
FIGS. 3C and 3D show schematically an improved method of shingling a horizontal disposition of documents to foreshorten the horizontal extent of a base used for such devices.
Figure 3E:
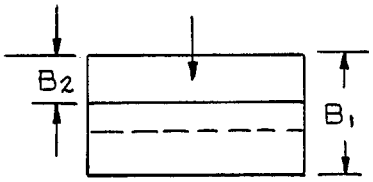
FIGS. 3E and 3F show schematically the vertical shingling of documents contemplated by the present invention.
Figure 3F:
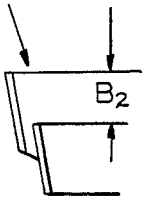
Figure 3D:
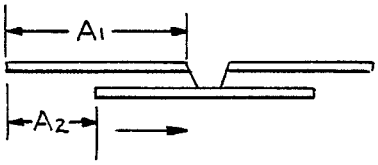

Referring now to FIGS. 3C through 3F, it has been proposed and this invention has successfully utilized the technique of shingling. In FIGS. 3C and 3D the horizontal disposition of the envelopes is an overlapped condition by positioning them at various stations in an overlap or laterally displaced planar disposition. It will be noted that the cumulative measurement of edge-to-edge disposition designated A2 in FIG. 3C is much reduced over that shown in FIG. 3A. The combined shingled distance of A1 plus A2 is hence, drastically reduced. Similarly, in the vertical shingled disposition of FIGS. 3E and 3F, the distance B2 is dramatically reduced over the dimension B2 shown in FIG. 3B. Therefore, the direction to be taken in the present invention is that shown in FIGS. 3C through 3F and particularly the vertical disposition shown in FIGS. 3E and 3F.

Figure 4A:
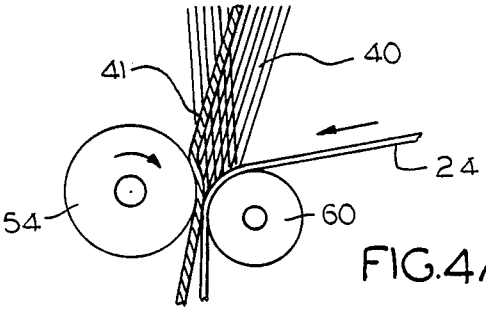
FIG. 4A is an enlarged partial view of the infeed mechanism of the device shown in FIG. 4.
Figure 4:
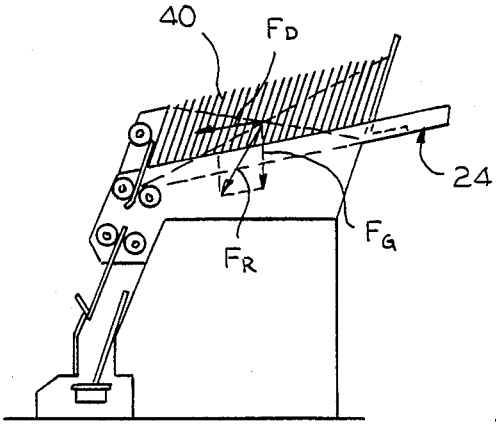
FIG.4 (PRIOR ART)
FIG. 4 is a disclosure of a prior art vertical document feed device wherein a positive angle feed tray is utilized.
Figure 5:
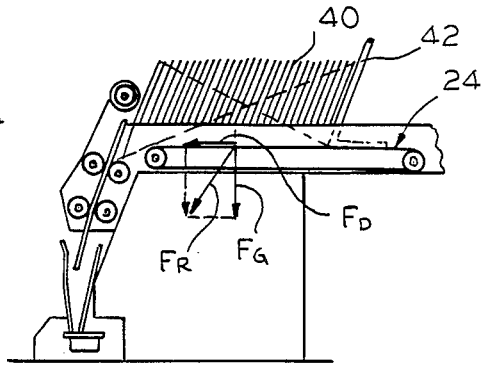
FIG.5 (PRIOR ART)
FIG. 5 is a schematic showing of a prior art device utilizing a horizontal feed tray.

In prior art vertical feed devices, as shown generally in FIGS. 4 and 5, there have been two approaches to the disposition of a feed tray. In FIG. 4, there is a showing of a positive angle feed tray 24 where gravity is utilized to move the stack of documents 40 down the inclined positive angularly disposed feed tray 24. The combined forces of gravity ($F_G$) plus the forwardly moving document ($F_D$) produce a resultant force ($F_R$) which has a significant forward component which results in a wedging effect due to the compression of documents adjacent the feed-in area. For the best example, see FIG. 4A wherein the documents become so compressed that the lead document 41 (shown in cross-section for clarity of illustration) is forced to come back against the remainder of the stack 40 for introduction into the nip between the feed rollers 54, 60. As can be well appreciated, when this occurs, there is a very strong tendency for multiple documents to be introduced between the rollers which is an undesirable condition.

Another variety of prior art is represented by a horizontally disposed feed tray with zero angularity as generally seen in FIG. 5. In this case it is necessary for the feed tray 24 to have a positive power feed method for movement of the support means 42 against the rear end of the stack forcing it forward against the in-feed rollers. This also produces a resultant force ($F_R$) having a forward component which causes a compressing of the stack adjacent the in-feed rollers and also causes wedging.

Figure 6:
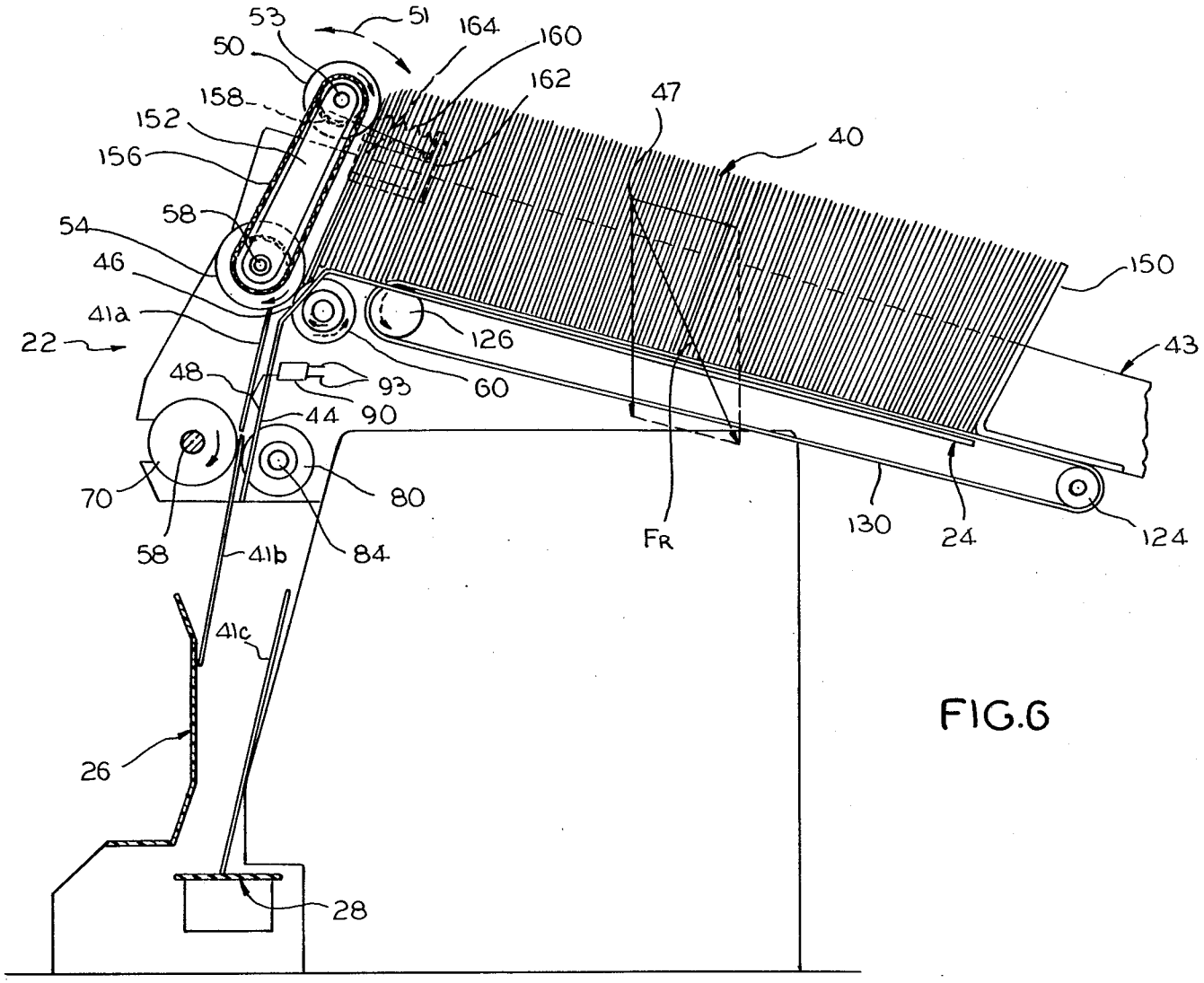
FIG. 6 is a schematic representation in side elevation of the negative angle feed tray contemplated by the present invention along with a substantial part of the vertical feed mechanism, in partial section.

Referring now to FIGS. 1, 2 and 6 through 16, the present invention contemplates a negative angle feed tray 24, details of which shall be set forth hereinafter, which is attached at its anterior end to an improved vertical feed mechanism 22. The feed mechanism 22 includes in-feed rollers 50 fixedly mounted on shaft 53 for rotation therewith. Shaft 53 is supported in parallel relation to powered shaft 58 by a unit including two rigid spaced elements 152 each having bearing means 154 adjacent opposite ends thereof and permitting relative rotation of shafts 53 and 58 within the bearing means 154. Positioned intermediate rigid elements 152 is a continuous belt 156 that engages a pair of sheave means 158 fixed to both shaft 58 as well as shaft 53 and thereby transmitting rotational power from shaft 58 to shaft 53. Shaft 53 is spring-loaded toward the stack 40 by spring 160 mounted at one end to bracket 162 and at the other end to shaft 53, for limited movement of rollers 50 toward and away from the stack 40, as designated by the double ended arrow 51 (FIG. 6). When the rollers 50 are excessively moved by the stack to the left, as viewed in FIG. 6, a switch 164 is activated by shaft 53 which will cut off power and stop the feed mechanism of the feed tray 24, to be described in more detail hereinafter.

Positioned below the feed rollers 50 is a drive shaft 58 carrying roller 54, drivingly interconnected by suitable means 156 to the shaft 53 and feed rollers 50, causing rollers 50 and 54 to rotate in the same direction. The connecting means 156 can take various configurations of power transmission devices, including timing belt means shown in FIGS. 1, 5 and 6.

Figure 15:
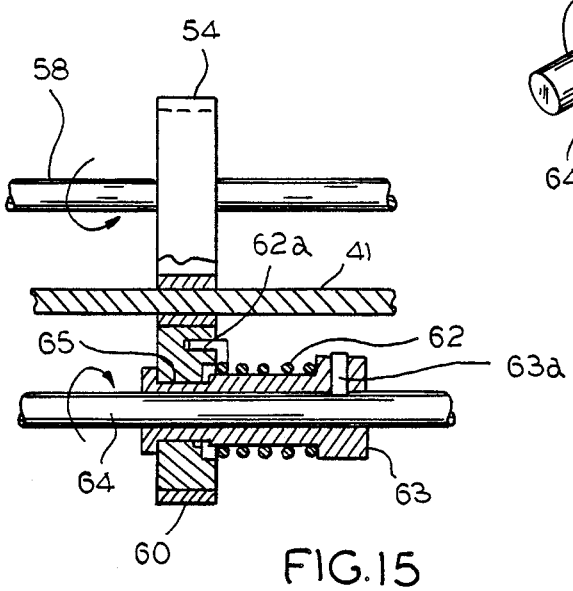
FIG. 15 is an elevational view in partial section of the mechanism shown in FIG. 10 as viewed from its backside.
Figure 16:
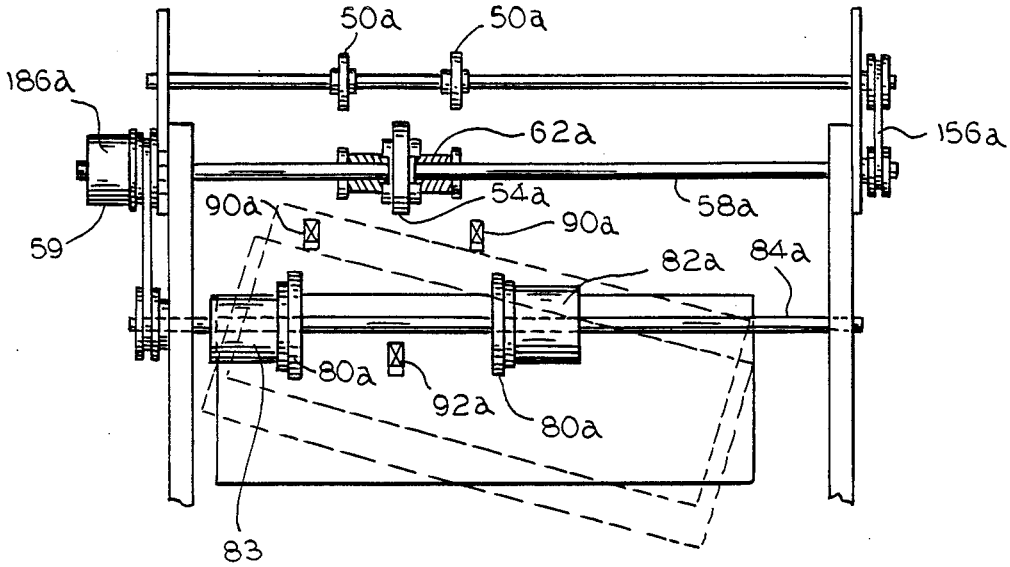
FIG. 16 is a schematic front vertical elevation of the embodiment shown in FIG. 2.

The drive roller 54 is positioned in line with and confronts a unique separation and back-up roller 60 which projects through a slot in the vertical guide plate member 44 which has an angled upper surface 46 (FIGS. 6 and 7) that provides a transition supporting means for the individual envelopes such as the lead document 41 moving from the feed tray 24 to the nip between rollers 54 and 60. The powered roller 54 is fixedly mounted on and receives a predetermined torque from shaft 58 while the separation roller 60 receives a torque of lesser value from the shaft 64, since the separation roller 60 is connected to shaft 64 by a suitable slip clutch means 62. One embodiment of slip clutch can be seen in FIGS. 14 and 15 and is of the spring variety whereby spring 62 is connected to the wheel or back-up roller 60 as by spring portion **62*a* (FIG. 15) and then surrounds the body 63 of the clutch in such a fashion that it will slip under predetermined torque conditions. Body 63 of the clutch is connected for rotation with shaft 64 by means of set screw 63*a*. Back-up roller 60 is rotatably mounted on spooled portion 65 of clutch body 63 (FIG. 15**).

Figure 8:
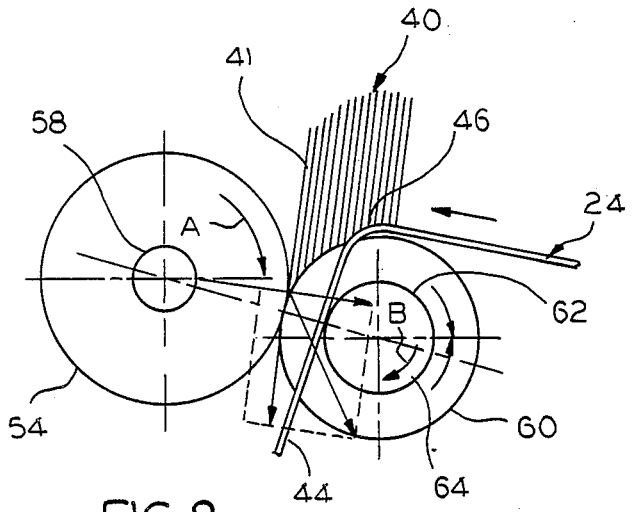
FIG. 8 is a partial schematic diagram of the document separating mechanism utilized in the present invention.

It will be noted in FIG. 8 that the direction of rotation of shaft 58 and shaft 64, designated by the arrows A and B respectively, is in the same direction and hence, when they meet face to face, they are going in opposite directions. However, when the tangential force of roller 54 impacts upon the circumference of back-up roller 60, roller 60 is driven in a direction opposite to the rotation of shaft 64. In this condition, spring 62 unwraps and loosens its grip on clutch body 63, thereby allowing back-up roller 60 to rotate in the same direction at the point of tangential impact as roller 54, under the driving influence of roller 54 and disconnected from shaft 64 by means of spring 62 slipping around clutch body 63. Thus, when the two rollers 54, 60 are in contact, the slip clutch 62, 63 will take effect and the roller 60 will reverse its direction and go in the same direction at the nip but complementary to the direction of rotation of driven roller 54.

Figure 10:
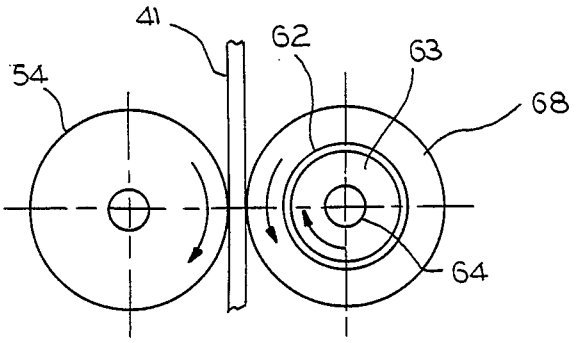
FIG. 10 is a schematic showing of a single document being fed through the separating mechanism.

When rollers 54, 60 are in direct contact, or when they are contacting opposite sides of the same document, i.e., as shown in FIG. 10, they will go in the direction of the document and hence, slip clutch 62, 63 permits the back-up roller 60 to move contra to the direction of the shaft 64 upon which roller 60 is rotationally mounted.

Figure 9:
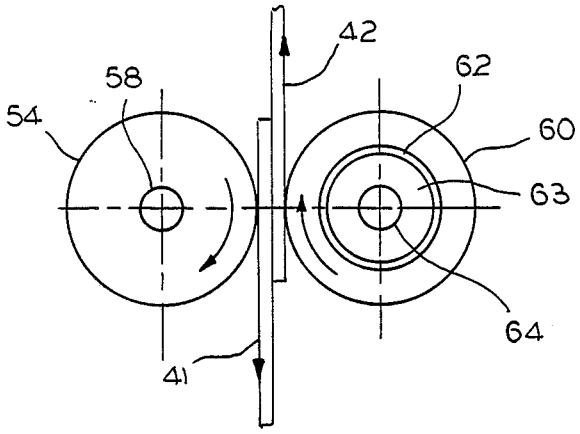
FIG. 9 is a schematic showing of the multiple feeding separation contemplated by the present invention.

However, as illustrated in FIG. 9, if a second document 42 is improperly introduced between the rollers 54 and 60, the coefficient of friction between documents 41 and 42 is lower than the coefficient of friction between rollers 54 and 60, and separation roller 60 will move in the direction of its own axle 64 as spring 62 tightens around clutch body 63 and provides a driving connection between shaft 64 and back-up roller 60. Hence, roller 60 will shoot or move the second document 42 in a direction back toward the stack 40, thereby avoiding the wedging or jamming effect. Document 41 continues to be advanced towards guide 26 under the influence of feed roller 50.

It should be noted that as the stack 40 moves up-hill on the rearwardly canted feed tray 24 (FIG. 6), the stack 40 tends to be compressed rearwardly towards its lower or distal end designated by the numeral 43 and significantly explained by the force diagram 47, where the resultant force $F_R$ acts away from the feed end of the stack and thus eliminates compressive forces from within the stack itself acting on lead document 41. Thus, as the stack 40 moves up-hill, it will present a relatively loose lead document 41 to be engaged by the in-feed roller 50. However, should a second document 42 inadvertently slip into the nip between rollers 54 and 60, the separation roller 60 will react as discussed above and will reject the second document 42 and cause it to return to the stack 40 for subsequent sequential delivery to the nip between the rollers 54 and 60.

The document 41 is then fed a predetermined distance beyond the in-feed and separation station, comprising the rollers 50, 54 and 60, to what is called the preconditioning station. The rollers 50, 54 and 60 cease to rotate, as will be described hereinafter, after the document 41 is fed downwardly and has also been deflected slightly forward by a protruberance 48 on the guide plate 44 (FIGS. 6 and 7) so that it temporarily contacts and rests upon a pair of idler rollers 70. Rollers 70 engage a pair of driving rollers 80 each being independently controlled by separate magnetic clutches 82, for purposes best set forth hereinafter.

When the document 41*a* (FIG. 7) is in the nip of rollers 54 and 60, and resting on the idler rollers 70, it is in what is called a "preconditioning station" and is shingled relative to the preceding document 41*b* which is caught in the nip between the rollers 70 and 80. When the operator has introduced the necessary information into the data bank, the operator strikes an "enter" key activating clutch 82 causing rollers 70 and 80 to commence accelerated rotation whereby the document 41*b* moves against the guide 26 until its lower edge is in the position of the document designated 41*c* which rests on its lower edge against the horizontal transporter belt-like 28 for delivery to the bar code printer 32. When the document is in the position designated 41*b*, this is the reading station where the operator has the opportunity to examine the address on the face of the document whereby the operator can then introduce the zip code, or other identifying data, by means of the keyboard into the data bank.

Figure 7:
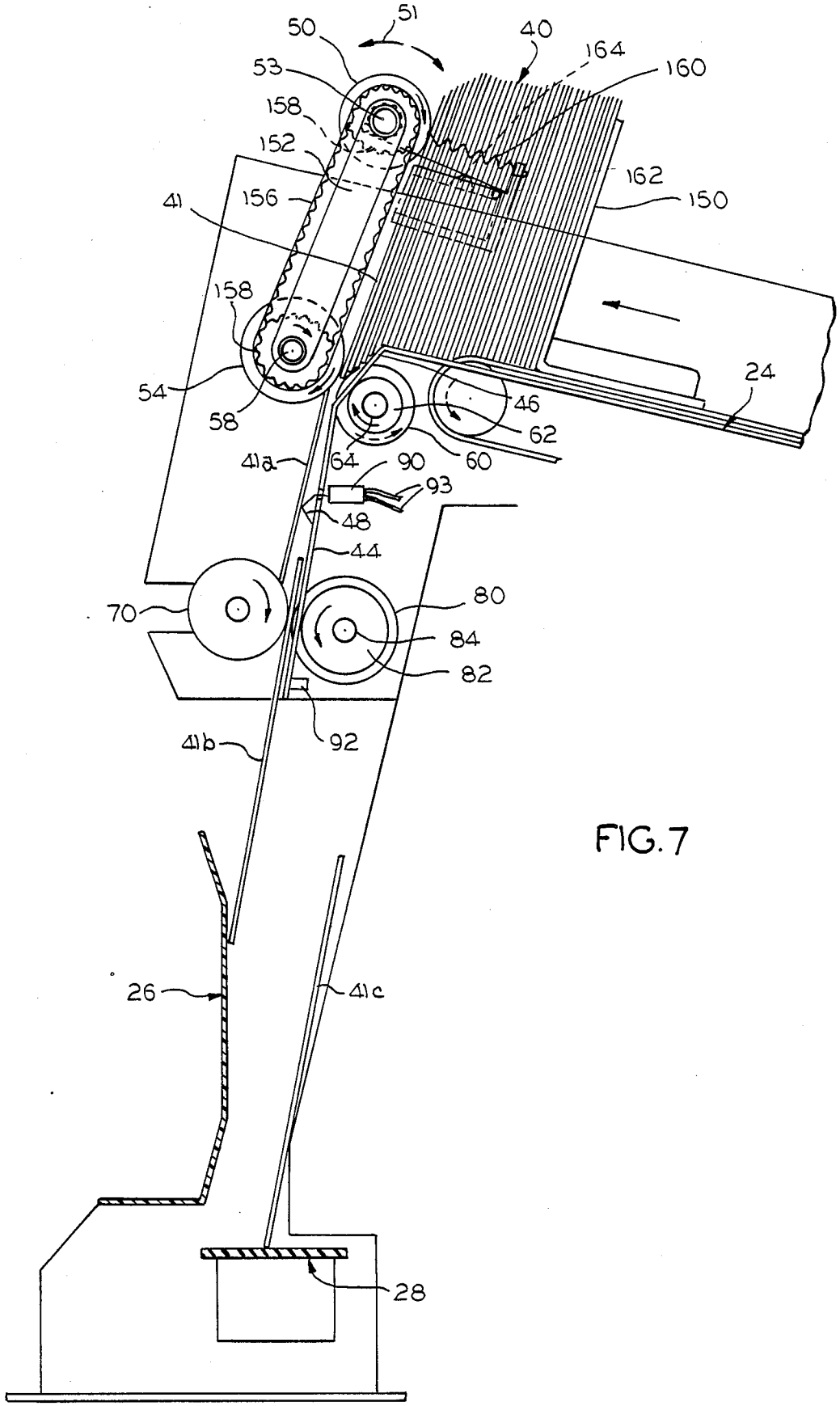
FIG. 7 is a schematic side elevational view in partial section of the vertical feed mechanism contemplated by the present invention.
Figure 11:
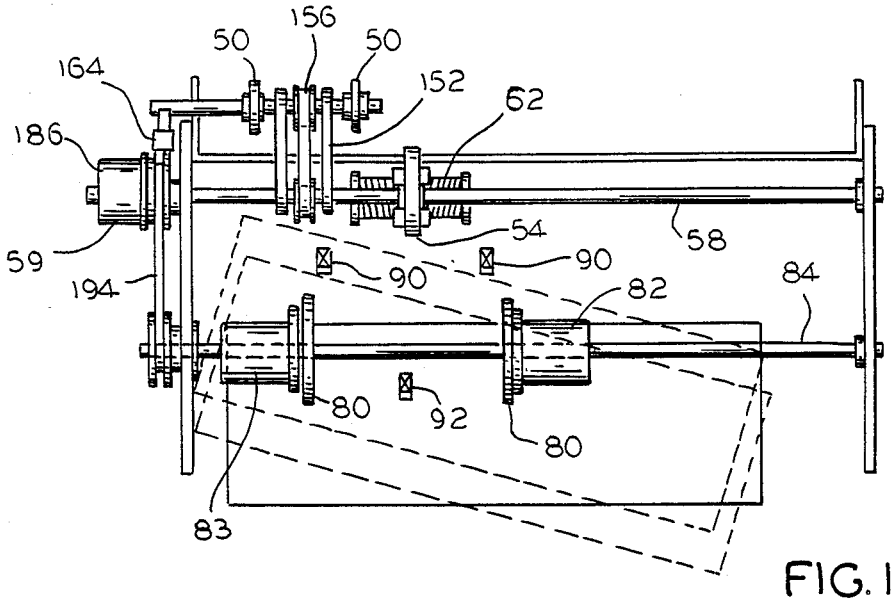
FIG. 11 is a schematic partial vertical elevation of the vertical feeder showing the feeding mechanism, the separating mechanism and the front of the skewing correction system of the embodiment shown in FIG. 1.
Figure 12:
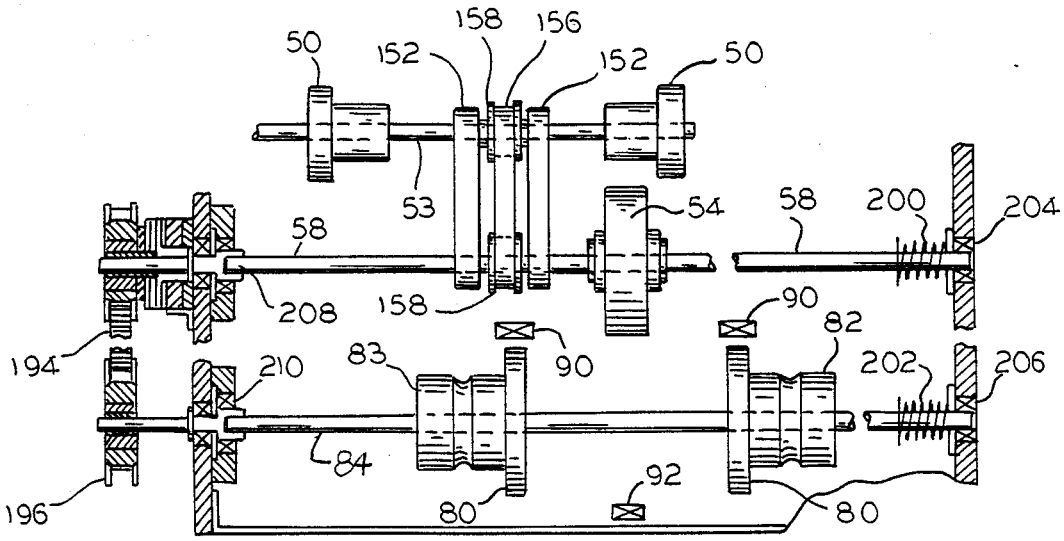
FIG. 12 is a more detailed front elevational view in partial section showing the means for quick assembly/-disassembly of the various components for cleaning and repair.

Referring to FIG. 7, the guide plate 44 is provided with a plurality of apertures behind which are located at least a pair of spaced sensors 90 positioned above the drive wheels 80 and at least one sensor 92 disposed slightly below the nip of the rollers 70 and 80. The purpose of the sensors 90 is dual, in that the at least two spaced sensors 90 permit the straightening out of a skewed envelope as shown in the dotted lines in FIG. 11. In FIG. 11, the skewed envelope would clear the sensor 90 to the right and would therefore, cause the electromagnetic clutch 82 to stop rotating the roller 80 on the right, as seen in FIG. 12, whereas the sensor 90 seen on the left would permit the left-hand roller 80 to continue rotating and thereby cause the skewed envelope to rotate counterclockwise about its nipped position in the grasp of the right-hand rollers 70 and 80 until it passes the left hand sensor 90 and is in its proper horizontal position. As it passes the left hand sensor 90 the power to the left hand electromagnetic clutch 83 is terminated and the envelope is retained in the desired horizontal position.

Figure 17:
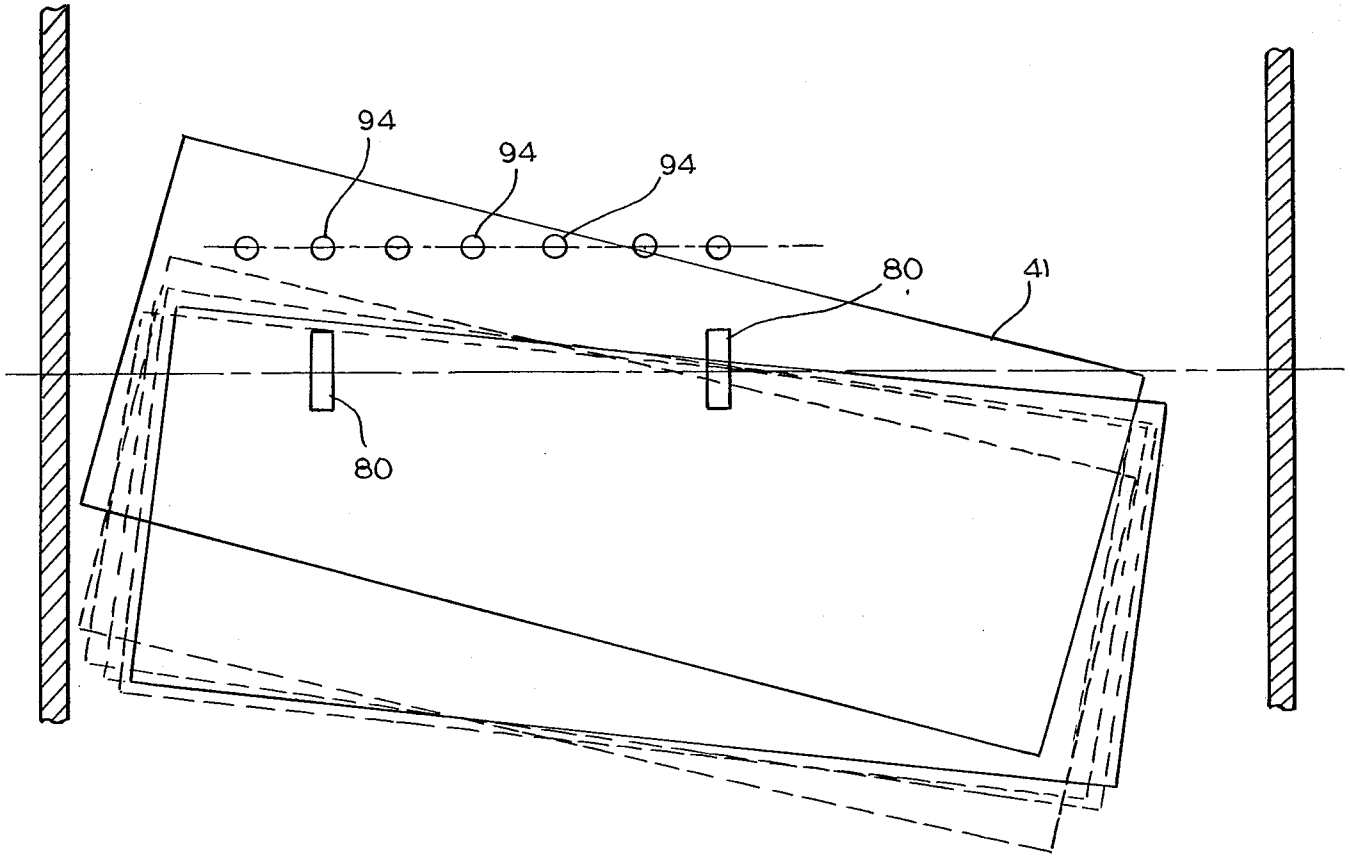
FIG. 17 is a schematic analysis of a further embodiment having an amplified skewing correction geometry of the type utilized in the present invention.

A variation on this arrangement is seen in FIG. 17, schematically, wherein a plurality of spaced sensors 94 are disposed along a horizontal line above the electromagnetically controlled rollers 80 thereby permitting more accurate correction of the skewed attitude of the envelope 41.

Figure 19:
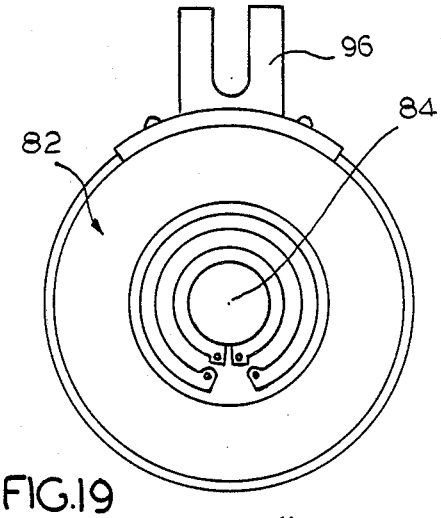
FIG. 19 is an end view of FIG. 18.
Figure 18:
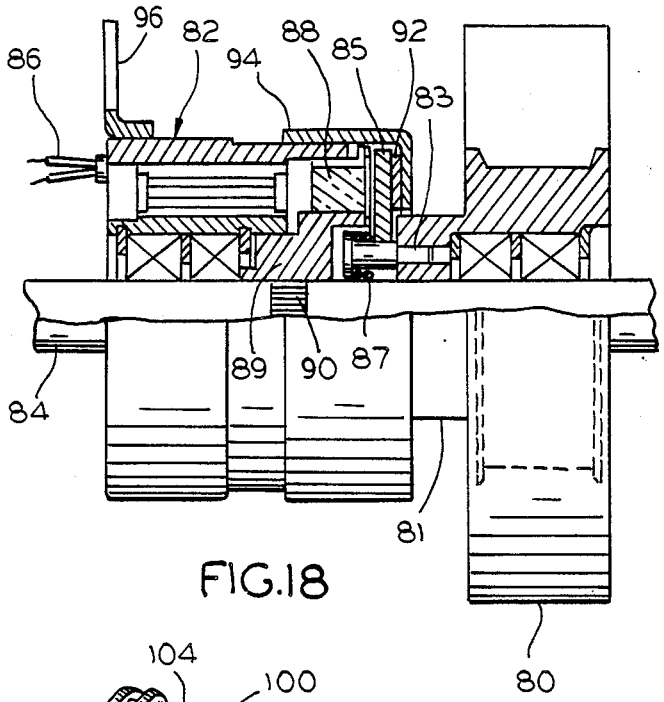
FIG. 18 is a vertical elevational view in partial section of an electromagnetic clutch of the variety used in the skewing correction system utilized in the present invention.

The sensors 90 and 92 also serve, secondarily, as a means for activation of the power to the shaft 58 for delivery of sequential envelopes from the stack 40. FIGS. 18 and 19 are a generalized cross-sectional display of a roller 80 and its magnetic clutch 82 affixed to the power shaft 84. The roller 80 includes a hub 81 that carries a plurality of headed shoulder studs 83 that support a spring-loaded axially moveable magnetizable plate 85. The plate 85 will move against the springs 87 and be magnetically clamped to coil 88 carried by rotor 89 keyed by splines 90 to the rotating shaft 84. The shaft 84 is constantly rotating by connection to the main motive power source, shown in FIG. 13, while the roller 80 normally rides freely on shaft 84 and is restrained against rotation by the brake-pad 92 that is fixed to the case 94. Case 94 is fixed by suitable fastening means through bracket 96 to the main structure of the mechanism. Roller 80 commences and maintains rotation solely upon energizing of the coil 88. The electrical lead means 86 supply power to the clutch 82 from a controller means, not shown, that interprets the signals from the sensors 90, 92 and 94.

Figure 13:
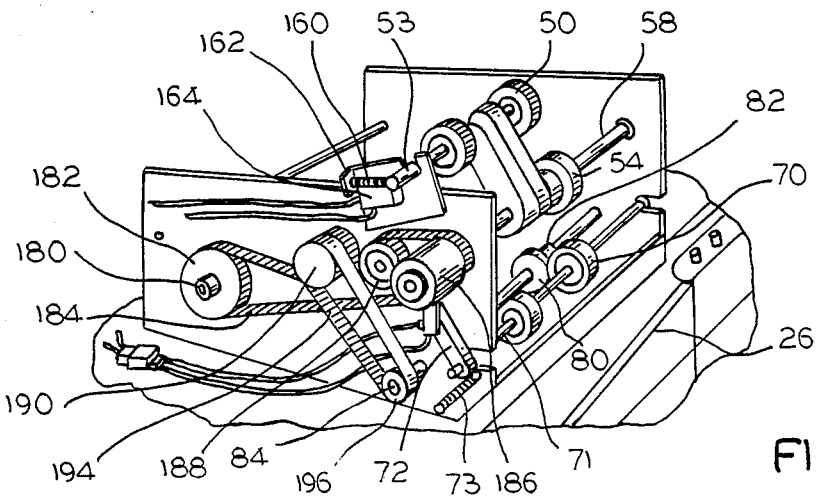
FIG. 13 is a perspective view of the left side, as seen in FIG. 1, of the vertical feeder showing the power train of the feeder.
Figure 14:
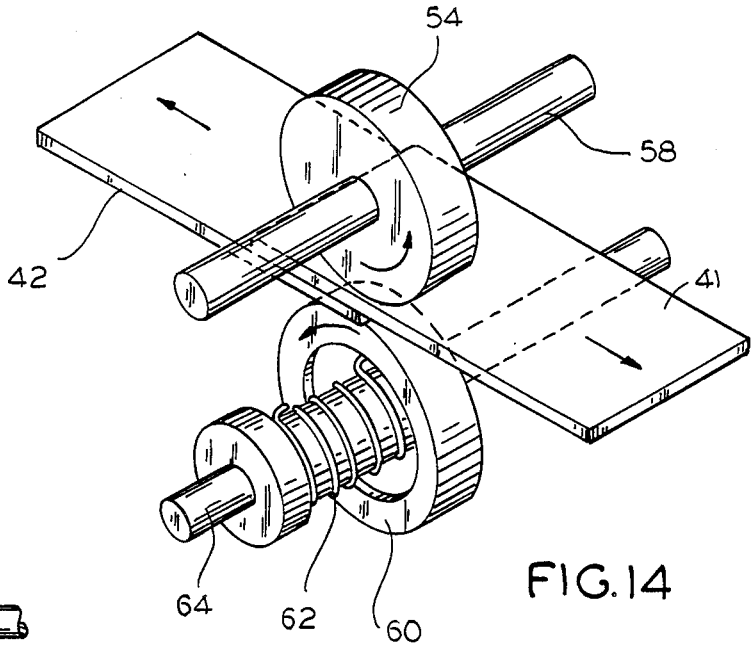
FIG. 14 is an enlarged perspective view of the two primary elements of the document separation mechanism of the present invention.

Referring now to FIG. 13, the power train that supplies the power and maintains the timed relation between the various elements of this invention can be seen on the left side of the mainbody of the mechanism. A main power shaft 180 extends through the sidewall via suitable bearing means, not shown, from an electric motor power source, not shown. Shaft 180 carries a timing gear 182 adapted to engage a timing belt 184. Belt 184 is an elongated member that extends forwardly from the underside of gear 182 to a second timing gear, not shown, carried by an electromagnetic clutch 186 riding on the end of shaft 58. Belt 184 wraps around a substantial portion of the timing gear associated with clutch 186 and rides over the top of idler gear 188, thence under an elongated idler gear 190 and over and around power drive gear 182. It should be noted that the preferred variety of belt to be used is a double faced timing belt that is capable of engaging timing gears with either face. Outboard of belt 184 is a second timing belt 194 that engages powered idler gear 190 and thence rides on sheave 196 connected to the end of shaft 84. The sequential operation of the power train will be discussed hereinafter.

A pair of non-powered idler rollers 70, that engage the electromagnetically controlled rollers 80, are mounted on a shaft 71 carried at opposite ends by a pair of spaced hinged arms 72 that are spring loaded by springs 73. This maintains the rollers 70 in engagement with rollers 80 but permits movement thereof to accomodate thick documents passing through the nip between the rollers. For maintenance and repair, the shafts 58 and 84 are spring loaded at one end, as at 200 and 202, respectively with free acceptance in the bearing means 204 and 206, respectively. The opposite ends 208 and 210, respectively, are slotted and engage a mating diametral pin driven by the power train. Axial movement of either of these shafts, 58 and 84, against their respective spring members permits disengagement from the power driven pins and ready removal for maintenance.

Figure 2:
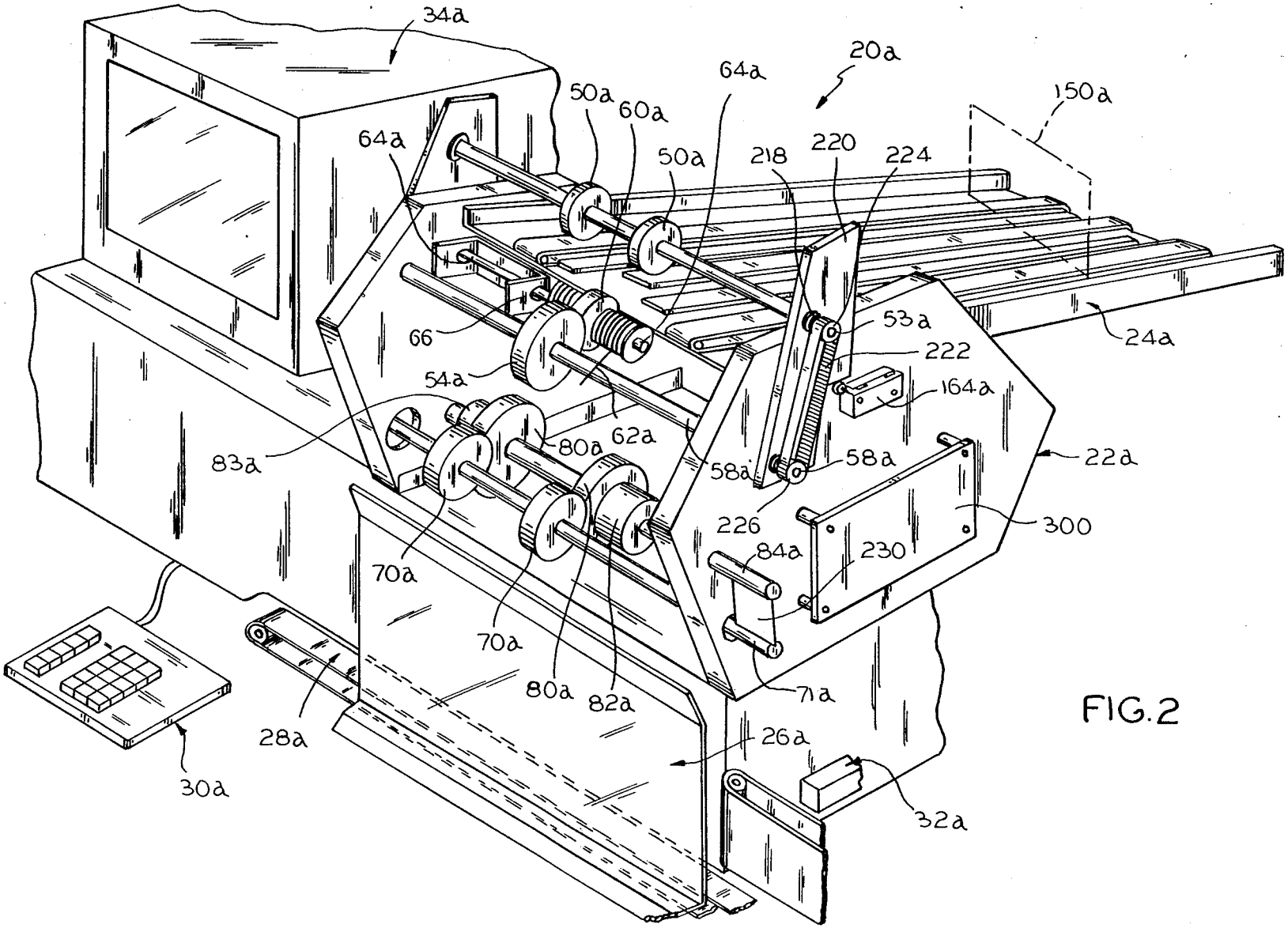
FIG. 2 is a perspective view of a modified embodiment of the device shown in FIG. 1.

A modified version of the above embodiment can be seen in FIG. 2, wherein similar parts are designated by similar numerals with the addition of the suffix "a". In this embodiment, the in-feed rollers 50*a* are supported on a shaft 53*a* that extends the entire distance between the opposite side walls and is supported on suitable bearing means 218 in a rotatable plate 220. Plate 220 is rotatable about shaft 58*a* to permit movement of rollers 50*a* under excessive pressure, if any, from the stack 40*a*, not shown, as it moves up the feed tray 24*a*. In the event that the plates 220 rotate, suitable means activates a switch 164*a* in some fashion to stop movement of the stack 40*a*. Power between shaft 58*a* to the shaft 53*a* is transmitted by belt means 222 engaging timing sheaves 224 and 226.

Additionally, in this embodiment the spring pressure on rollers 70*a* may be provided by the leaf spring means 230 extending between shafts 71*a* and 84*a*.

During the normal operation of the mechanism contemplated by the present invention, a stack of envelopes or documents are placed on the feed tray 24 and fed up the negatively angled tray until the first document 41 engages the infeed rollers 50. A single envelope 41 is moved down the inclined surface 46 by the rollers 50 until the document engages the nip between rollers 54 and 60. Assuming only a single document is presented to the nip of rollers 54 and 60, the envelope 41 is moved down the guide plate 44 over the protuberances 48 until the envelope engages the idler rollers 70 and sits there. The movement of the envelope past the sensor 90 causes the electromagnet 186 to disengage the shaft 58 from the timing belt 184 and to not feed any more envelopes out of the stack. In the event that the envelope being described is the first envelope out of the entire stack it would immediately be moved into the nip between rollers 70 and 80 and be moved downwardly until it reached the position **41*b* behind the guide means 26 and retained in the gripped position shown by inactivation of rollers 80 by the lower sensor means 92 (after the sensors 90 had controlled the electromagnetic clutches 82 and 83 to correct skewing of the envelope 41*b*, if any). The operator can observe the data on the face of the envelope and introduce certain data, i.e. zip code or other matters, into a data bank by means of the keyboard 30. After introducing the data an enter button or other means on the keyboard is engaged by the operator causing the rollers 80 to be activated and the envelope dropped from the nip of rollers 70 and 80 to fall behind guide 26 to the lateral transport means 28 to move over to the dot matrix printer 32 (shown schematically) where indicia means is applied to the envelope by printer 36** based on the data introduced by the operator.

The power train source will continuously rotate shaft 180 as long as the separation and other operations are continuing, however, clock means included in the electronic controls, designated broadly by the panel 300, will shut off the power after a predetermined time if no activity is taking place. If things are progressing generally smoothly, the belt 184 is constantly running and power shaft 58 rotates only when clutch 186 is engaged. Similarly, the movement of belt 184 over the powered idler timing gear 190 causes the belt 194 to constantly rotate shaft 84, however, no power or movement of rollers 80 takes place unless the clutches 82 and 83 are engaged.

In the event that excessive pressure from the stack causes the in-feed rollers 50 to move a predetermined distance forward, the switch 164 will be activated and the power to motor 140 will be cutoff and further movement of the stack prevented until the rollers 50 resume a desired position and the cycle repeated.

Figure 20:
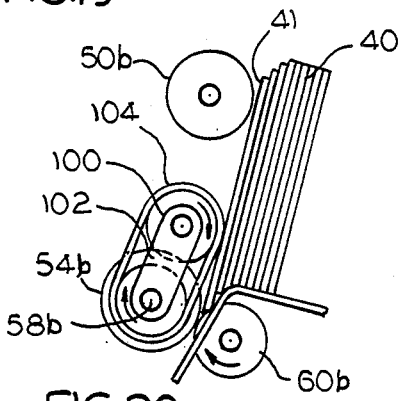
FIG. 20 is a side elevational view in partial section of another embodiment utilizing combined in-feed and separation rollers.
Figure 21:
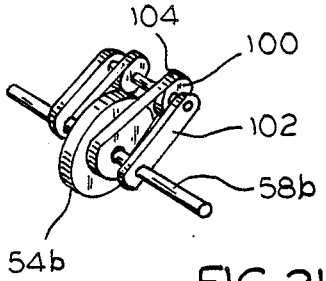
FIG. 21 is a perspective view of the device shown in FIG. 20.

While the earlier described embodiments showed the use of a belt means 156 and **156*a* (see FIGS. 11 through 13 and 16) for the transmission of power from the driven roller shaft 58 to the in-feed rollers 50, it is also possible to provide a localized transmission of power such as seen in a further embodiment in FIGS. 20 and 21. In this embodiment, not only is there an in-feed roller 50*b*, but also a localized additional in-feed roller 100 which is interconnected by a linkage 102 mounted on the drive shaft 58*b* and having document contact belt means 104 riding over the secondary roller 100. This arrangement merely increases the pressure on the stack 40 and results in improved control of the lead document 41**.

Figure 22:
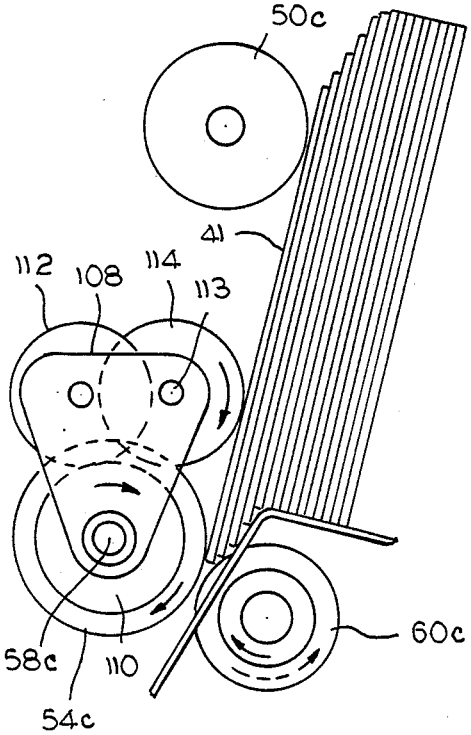
FIG. 22 is a side elevational view of still another embodiment of a power transmission utilized between the drive roller and an in-feed roller.
Figure 23:
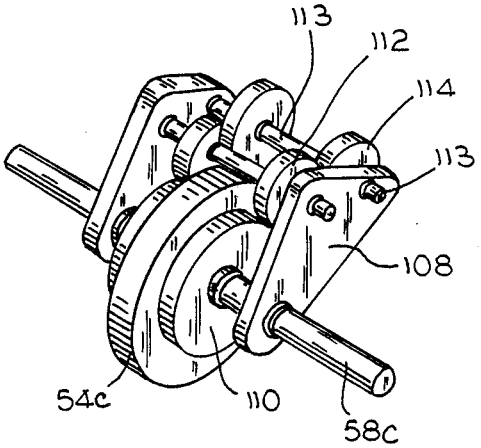
FIG. 23 is a perspective view of the device generally shown in FIG. 22.

Referring now to FIGS. 22 and 23, wherein a further embodiment of the invention is shown, the drive roller **54*c* carries a secondary shoulder or roller 110 which is a substantially rigid member, contacting an intermediate idler roller 112 which contacts the shaft 113 carrying the secondary in-feed roller 114. This arrangement is all maintained in a triangular disposition by the linkage 108 rotatably mounted on power shaft 58*c*. The roller 114 tends to assist in-feed roller 50*c* in the selection of the lead document 41**.

Figure 24:
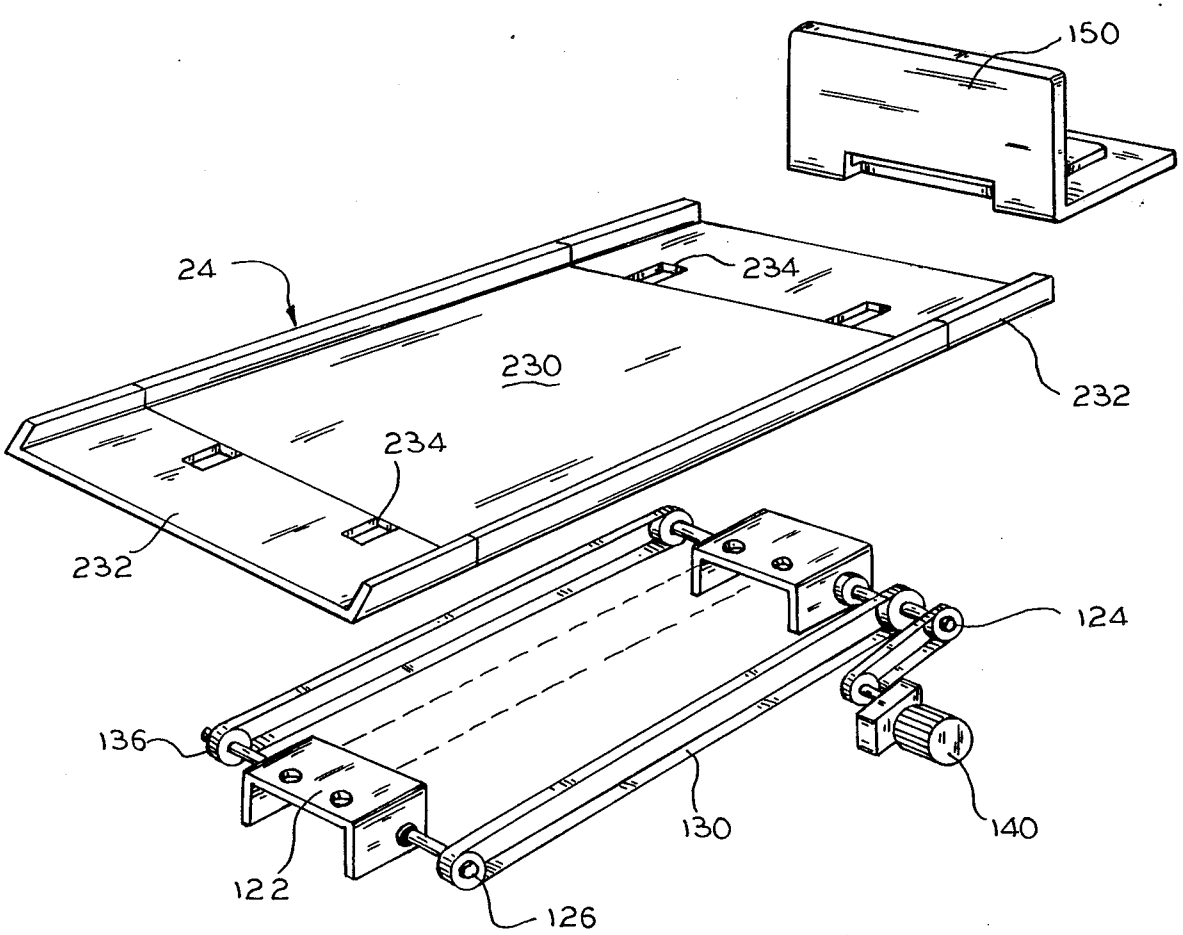
FIG. 24 is an expanded perspective view of a feed tray of the type contemplated to be used in the negative angle disposition shown in FIG. 1.

The simplified negative feed tray 24 shown in FIG. 1 is shown in the schematic expanded view of FIG. 24. The feed tray 24 mechanism includes a pair of spaced shafts 124 and 126 supporting a pair of belts 130 and 136 that are powered by a motor 140. The shafts are supported by bearing means 122 spaced a predetermined distance. The tray per se includes a central portion 230 having a length less than said predetermined distance so that it can be slipped under the belts 130 and 136 and thence the end portions 232 can be slipped into cooperative relation to mating elements carried by said central portion 230. The end portions include cutouts 234 that will accept and permit the sheaves carrying the belts 130 and 136 to project above the tray central portion 230 so that the belts can move freely across the upper surface of the central portion 230 and carry the stack up the negative angular disposition thereof. The belts are preferably tacky or have a low durometer so that the backup means 150 can merely rest on the belts and move therewith without any other connection than by gravitational riding on the belts.

Figure 25:
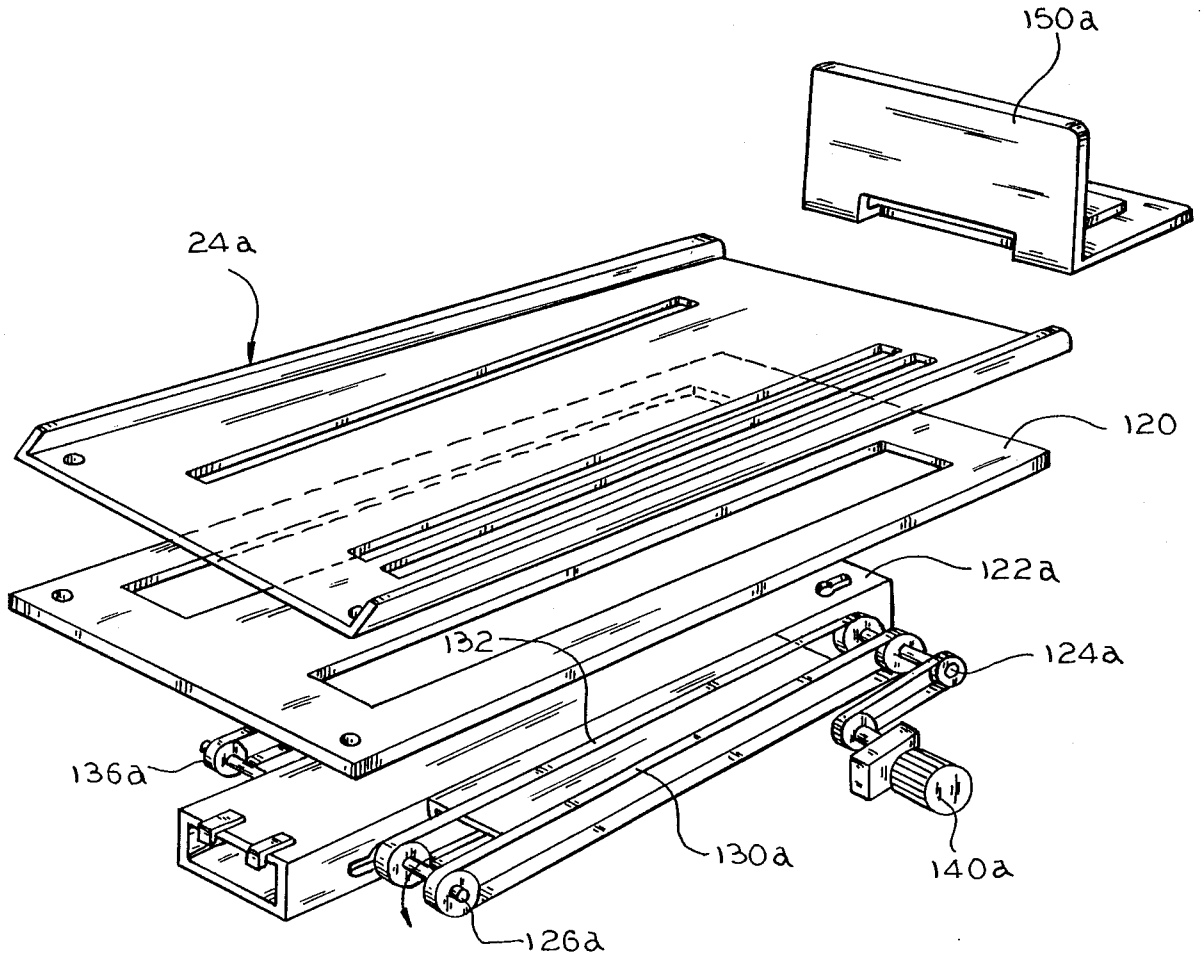
FIG. 25 is an expanded perspective view of another feed tray embodiment of the type shown in FIG. 2.

A modified feed tray which is utilized in the other embodiment of this invention, as shown in FIG. 2, is generalized in a schematic exploded view shown in FIG. 25 wherein the feed tray **24*a* is bolted to a base 120 that is in turn, mounted on a frame 122*a* that carries transverse shafts 124*a* and 126*a* along with suitable sheaves for carrying a plurality of belt means 130*a*–136*a*. These are driven by a power source 140*a* as is generally described in my copending application Ser. No. 07/109,491, filed Oct. 16, 1987. In that copending application, the belts 130*a*–136*a* extend through suitable slot means and serve to move the stack 40 uphill towards the in-feed rollers 50. A back support 150*a* is springloaded to keep the stack moving along with the belts 130*a*–136*a***. The particular configuration of the feed tray is not a part of the present invention other than as it is used in the negative angular disposition.

Thus, a unique improved document feed mechanism for shingling documents through a plurality of stations, the unique usage of a negative angle feed tray to overcome wedging and jams in document feeding, a unique singling system for eliminating two or more documents from entering the feeding station, as well as a unique correction of skewing of documents during their vertical feed has been provided. The primary purpose of the CRT 34 shown in FIG. 1 relates to the display of the operation and condition of the equipment rather than displaying any information from the keyboard 30. Similarly, the bar code printer 32 is well known in the art and is not part of this invention.

While modifications and equivalents will be apparent to those skilled in the art, we intend to be limited solely by the appended claims wherein,

We claim:

1. An improved document feed mechanism for feeding documents in a vertical direction through at least two stations including means for shingling said documents in at least one station by having successive ones of said documents overlap one another a predetermined amount to thereby compress the amount of vertical space required for the feeding operation as opposed to the space that would be required if said documents were fed top edge to bottom edge, respectively, while exposing indicia on a document in at least one of said stations, said feed mechanism further including means for delivering documents to said feed mechanism located at an upper elevation and means for transporting documents away from said feed mechanism at a lower elevation, and said feed mechanism controlling and moving said documents between said elevations through a plurality of stations, at least one in-feed roller for moving a facing document downwardly from the end of an edge-stacked stack of documents being moved broadside by said delivery means towards said feed mechanism, said feed mechanism also including as one of said plurality of stations a separation station that insures that only one document is moved downwardly from said stack by said at least one in-feed roller, one of said plurality of stations being a pre-conditioning station having a drive roller that moves a separated document with a predetermined torque and coefficient of friction against one face of said document, guide diverter means acting on the other face of said document to move said document to a predetermined offset location relative to its predetermined vertical path through said feed mechanism.

2. An improved document feed mechanism of the type claimed in claim 1 wherein said feed mechanism includes as one of said plurality of stations an acceleration station which first moves said document from said predetermined offset location to a second lower position in said vertical movement thereof and then retains said document by an upper portion thereof in said second lower position for observation of said document by an operator who will observe data relating to said document and enter data relating to said document into a data retaining means, whereupon said document will be accelerated downwardly into guide means directing said document to said transporter whereby said document will be transported laterally from said feed mechanism to a suitable printing mechanism which will apply the data from the data retaining means in a predetermined format to one of the faces of said document.

3. An improved document feed mechanism of the type claimed in claim 1 wherein said separation station includes a driven power roller having a predetermined torque and coefficient of friction and a back-up roller that has a predetermined magnitude of power that is less than said driven power roller, slip clutch means between said back-up roller and the source of said predetermined magnitude of power, said back-up roller normally rotating in opposition to said driven power roller, however, when said back-up roller is under the influence of the driven roller, either by direct contact with said driven roller or in contact with a document being contacted by said driven roller on the opposite face thereof, said back-up roller will move complementarily thereto and accommodate the movement of a single document through the feed means, however, when a second document moves down behind the first document contacted by said in-feed roller said back-up roller will move the second document back upwardly into the stack of documents being fed into the mechanism and to therein await its sequential turn.

4. An improved document feed mechanism of the type claimed in claim 2 wherein said accelerator station includes at least two laterally spaced independently powered rollers each having a backup roller, at least two laterally spaced sensing means adapted to sense a skewed condition in said document being fed, means controlling said independently powered rollers to brake or accelerate the vertical movement of an appropriate end of said document to thereby correct the skewed condition thereof and present a properly oriented document in a horizontal disposition to said operator for observation thereof.

5. An improved document feed mechanism of the type claimed in claim 2 wherein said guide diverter means moves said document out of the nip of said acceleration station rollers but with said document overlying the preceding document in shingled relation.

6. An improved document feed mechanism of the type claimed in claim 5 wherein movement of said document out of said reading station causes rotation of said drive roller to take place and the next sequential document that was held against said guide to drop downwardly against the accelerator driven roller and be pulled into the nip between said driven roller and its backup roller and moved over the end of aid diverting guide into said next station.

7. An improved document feed mechanism of the type claimed in claim 1 wherein said means for delivering documents to said feed mechanism includes a negative angle feed tray.

8. An improved document feed mechanism of the type claimed in claim 7 wherein said feed tray includes power means for advancing a stack of edgewise stacked documents uphill to a position where at least one in-feed roller will contact the lead document of said stack and feed same into said document feed mechanism.

9. An improved document feed mechanism of the type claimed in claim 8 wherein said feed tray power means includes at least one belt means for contacting the lower one edge of said stack and advancing same uphill to a position whereby said at least one in-feed roller can contact the first document in said stack.

10. An improved document feed mechanism of the type claimed in claim 8 wherein said negative angle feed tray has a main tray-like base that has the anterior end of said base positioned at the upper level of the feed mechanism, the opposite distal end of said tray being disposed angularly below the horizontal as measured at its anterior end, the angle created by this negative disposition being sufficient to cause said edgewise stack of documents to be compressed towards said distal end of the tray and to not have a positive pressure, from the weight of the stack, against the leading document in said stack, whereby said lead document can be readily removed from that position by said in-feed roller without substantially effecting the next sequential document in said stack.

11. An improved document feed mechanism of the type claimed in claim 9 wherein said feed tray power means includes two laterally spaced power belt means moving said edgewise positioned stack from said lower compressed end up-hill towards the position where said at least one in-feed roller will contact the lead document of said stack and feed same readily into said document feed mechanism.

12. An improved document feed mechanism of the type claimed in claim 11 wherein said negatively disposed feed tray causes said stack to be compressed by gravity, said power belt means being used to move said stack uphill and apply pressure of said lead envelope against said at least one feed roller, said belt means having an intermittent drive for transporting said stack up-hill, however, when said transporter stops the stack maintains compression against the lower or back support, any compression against said at least one in-feed roller is only when said transporter is activated.

13. An improved document feed mechanism of the type claimed in claim 12 wherein said in-feed roller is sensitive to excessive pressure from said stack, switch means on said in-feed roller shaft, low level spring means maintaining said in-feed roller under slight pressure against said stack, when present, said transporter motor normally being activated, said switch means controlling said transporter motor, whereby, when excessive pressure exists between said in-feed roller and said stack the movement of said in-feed roller activates said switch means and causes said transporter motor to stop until said pressure is relieved by removal of documents from said stack either manually by the operator or by normal sequencing of said in-feed roller and said document feed mechanism to move sequential documents from said stack and thereby reactivate said transporter motor.

14. An improved document feed mechanism of the type claimed in claim 2 wherein said plurality of stations are equipped with a plurality of feed rollers and a plurality of sensing devices that are capable of determining the presence or absence of a document at a particular station, when said mechanism is on, but devoid of documents, all of the rollers are rotating, the first document passing into said mechanism is moved downwardly through said stations until it reaches said reading station where said rollers hold said document and stop it at a predetermined position determined by said sensing devices to permit observation of said document by the operator at said reading station.

15. An improved document feed mechanism of the type claimed in claim 2 wherein said printing mechanism is a bar code printer and the data entered by said operator is the zip code presented in an address on the one face of said document, said printing mechanism printing the equivalent bar code for said zip code on said document whereby said document can be automatically sorted at later stations by equipment reading the bar code printed on said document.

16. An improved document feed mechanism having means for presenting documents sequentially in a vertical orientation including a negative angle feed tray, said tray includes means for advancing a stack of edgewise stacked documents uphill to a position where at least one in-feed roller can contact the lead document of said stack and feed same into said document feed mechanism, said means for advancing said stack being a powered means including at least one continuous belt means for contacting the lower one edge of the documents in said stack and advancing same uphill to a position whereby said at least one in-feed roller can contact the first document in said stack, said feed tray power means including at least two laterally spaced power belt means moving said edgewise positioned stack from said lower compressed end up-hill towards the position where said at least one in-feed roller will contact the lead document of said stack and feed same readily into said document feed mechanism, said in-feed roller being sensitive to excessive pressure from said stack, switch means on said in-feed roller shaft, low level spring means maintaining said in-feed roller under slight pressure against said stack, when present, said transporter motor normally being activated, said switch means controlling said transporter motor, whereby, when excessive pressure exists between said in-feed roller and said stack the movement of said in-feed roller activates said switch means and causes said transporter motor to stop until said pressure is relieved by removal of documents from said stack either manually by the operator or by normal sequencing of said in-feed roller and said document feed mechanism to move sequential documents from said stack and thereby reactivate said transporter motor.

17. An improved document feed mechanism as claimed in claim 16 wherein said negative angle feed tray has a main tray-like base that has the anterior end of said base positioned at the upper level of the feed mechanism, the opposite distal end of said tray being disposed angularly below the horizontal as measured at its anterior end, the angle created by this negative disposition being sufficient to cause said edgewise stack of documents to be compressed towards said distal end of the tray and to not have a positive pressure, from the weight of the stack, against the leading document in said stack, whereby said lead document can be readily removed from that position by an in-feed roller without substantially effecting the next sequential document in said stack.

18. An improved document feed mechanism of the type claimed in claim 16 wherein said negatively disposed feed tray causes said stack to be compressed by gravity, said power belt means being used to move said stack uphill and apply pressure of said lead envelope against at least one feed roller, said belt means having an intermittent drive for transporting said stack up-hill, however, when said transporter stops the stack maintains compression against the lower or back support, any compression against said at least one in-feed roller is only when said transporter is activated.

* * * * *